US008915181B2

(12) United States Patent
Kohno et al.

(10) Patent No.: US 8,915,181 B2
(45) Date of Patent: Dec. 23, 2014

(54) PRESS LOAD CONTROLLING APPARATUS FOR MECHANICAL PRESS

(75) Inventors: Yasuyuki Kohno, Sagamihara (JP); Tadahiro Kondo, Sagamihara (JP); Junji Makabe, Sagamihara (JP); Akira Yamanouchi, Sagamihara (JP)

(73) Assignee: Aida Engineering, Ltd., Sagamihara-Shi, Kanagawa (JP)

( * ) Notice: Subject to any disclaimer, the term of this patent is extended or adjusted under 35 U.S.C. 154(b) by 448 days.

(21) Appl. No.: 13/276,798

(22) Filed: Oct. 19, 2011

(65) Prior Publication Data

US 2012/0090482 A1 Apr. 19, 2012

(30) Foreign Application Priority Data

Oct. 19, 2010 (JP) ..... 2010-234830

(51) Int. Cl.
*B30B 15/24* (2006.01)
*B30B 1/26* (2006.01)

(52) U.S. Cl.
CPC ..... *B30B 1/265* (2013.01)
USPC ..... 100/46; 100/48

(58) Field of Classification Search
CPC .. H01R 43/0427; B21C 311/00; B21D 11/02; B21D 25/00; B21D 1/14; B21D 24/02; B21B 31/32; B21J 9/12; A01F 15/0825; B30B 9/3025; B30B 1/18
USPC ..... 72/20.1, 20.2, 21.5, 443, 453.01, 72/453.03, 453.18, 454; 100/43, 46, 48, 100/49, 50
See application file for complete search history.

(56) References Cited

U.S. PATENT DOCUMENTS 3,908,436 A * 9/1975 Bothe ..... 72/431
4,757,705 A * 7/1988 Arima et al. ..... 72/456
6,240,758 B1 * 6/2001 Nagakura ..... 72/20.1
(Continued)

FOREIGN PATENT DOCUMENTS

JP 62-046198 U 3/1987
JP 6-155088 A 6/1994
(Continued)

OTHER PUBLICATIONS

Japanese Office Action with English translation issued in Japanese Application No. 2010-234830 issued on Dec. 2, 2013.

*Primary Examiner* — Shelley Self
*Assistant Examiner* — Onekki Jolly
(74) *Attorney, Agent, or Firm* — McDermott Will & Emery LLP

(57) ABSTRACT

In a mechanical press, the pressure (cylinder force) of a hydraulic pressure chamber of a cylinder-piston mechanism provided in a slide of the mechanical press can be variably controlled with a high responsiveness by a hydraulic pump/motor driven by an electric servomotor, in response to a cylinder force command corresponding to the press load command. Accordingly, even if a die height value is set to a value small enough to cause an overload, the press load can be restricted before the occurrence of the overload, and this can save the trouble of strictly adjusting the die height value. Further, pressure-application time in the vicinity of a bottom dead center can be lengthened, and a breakthrough phenomenon can be suppressed from occurring at the end of pressure application. Still further, because the overload does not occur, pressure oil is not relieved, so that the interruption of a press operation is avoided.

22 Claims, 10 Drawing Sheets

(56) References Cited

U.S. PATENT DOCUMENTS

| | | | | |
|---|---|---|---|---|
| 6,874,343 | B1 * | 4/2005 | Ariji | 72/20.1 |
| 2009/0025444 | A1 * | 1/2009 | Suzuki | 72/16.1 |
| 2009/0025577 | A1 * | 1/2009 | Aoki et al. | 100/35 |
| 2009/0071218 | A1 * | 3/2009 | Kohno et al. | 72/351 |
| 2009/0078016 | A1 * | 3/2009 | Suzuki | 72/20.1 |
| 2010/0139506 | A1 * | 6/2010 | Jose | 100/35 |

FOREIGN PATENT DOCUMENTS

| | | | |
|---|---|---|---|
| JP | 8-118083 | A | 5/1996 |
| JP | 2001-1199 | A | 1/2001 |
| JP | 2006-315074 | A | 11/2006 |

* cited by examiner

PRESS LOAD CONTROLLING APPARATUS FOR MECHANICAL PRESS

CROSS REFERENCE TO RELATED APPLICATIONS

The present application claims priority under 35 U.S.C. §119 to Japanese Patent Application No. 2010-234830, filed Oct. 19, 2010, which is incorporated herein by reference.

BACKGROUND OF THE INVENTION

1. Field of the Invention

The presently disclosed subject matter relates to a press load controlling apparatus for a mechanical press driven by a crank or a linkage mechanism, and more particularly, to a technique of controlling a press load by a cylinder-piston mechanism provided in a slide of a mechanical press.

2. Description of the Related Art

Up to now, mechanical presses of this type have been described in Japanese Patent Application Laid-Open Nos. 2001-1199, 08-118083, and 06-155088.

An overload preventing apparatus for a mechanical press described in Japanese Patent Application Laid-Open No. 2001-1199 is provided with a hydraulic pressure chamber for overload absorption in a slide of the mechanical press, and is also provided with an overload preventing valve that performs a relief operation when the pressure of the hydraulic pressure chamber exceeds a set overload pressure. The overload preventing valve is provided with a valve-closing spring and a pneumatic cylinder that press a relief member against a relief valve seat. Compressed air having a predetermined pressure is supplied to and discharged from a pneumatic operation chamber, of the pneumatic cylinder, whereby the set overload pressure can be changed along a press capacity curve.

In the overload preventing apparatus for the mechanical press described in Japanese Patent Application Laid-Open No. 2001-1199, the compressed air having the predetermined pressure is supplied to and discharged from the pneumatic operation chamber of the pneumatic cylinder included in the overload preventing valve, whereby the set overload pressure is changed along the press capacity curve. In the case where the pressure of the hydraulic pressure chamber for overload absorption provided, in the slide of the mechanical press exceeds the set overload pressure, the overload preventing valve performs the relief operation, to thereby prevent the overload.

An overload protector for a link press described in Japanese Patent Application Laid-Open No. 08-118083 is provided with: an accumulator that adjusts the hydraulic pressure of a hydraulic pressure chamber provided in a slide; and a hydraulic pump that supplies pressure oil for hydraulic pressure adjustment to the accumulator. The hydraulic pump is controlled such that the pressure of the hydraulic pressure chamber does not exceed a predetermined value.

An applied pressure holding apparatus for a mechanical press described in Japanese Patent Application Laid-Open No. 06-155088 is provided with a hydraulic cylinder interposed, between a connecting rod, and a slide. Hydraulic oil supplied to and discharged from the hydraulic cylinder is controlled by a hydraulic pressure control mechanism, and relative motion is caused between the connecting rod and the slide. The slide is maintained at a given position whereas the connecting rod moves, and the applied pressure is held near the bottom dead center. As a result, a high-quality pressed product without unevenness in shaping can be obtained even from a material having large springback.

SUMMARY OF THE INVENTION

The conventional mechanical presses of this type have the following problems.

(1) The die height value needs to be strictly adjusted (by an adjustment mechanism) for each product.

Depending on a product or a press machine, even if the die height value is strictly adjusted, the die height value needs to be adjusted again according to the operating time (so as to deal with linear expansion of the machine). If the die height value is not strictly adjusted and the die height value is excessively small, a die and a product sandwiched between a press slide and a bolster, eventually, the press machine itself is subjected to an overload due to (an action for elastic recovery from) elastic deformation of the machine (including a column and an in-slide cylinder/hydraulic pressure chamber), so that the die and the machine are broken. Conversely, if the die height value is excessively large, the press (shaping) load acting on the die is too small to shape a satisfactory product.

(2) In order to suppress such an overload acting on the die and the machine, the pressure-application time at the press bottom dead center is restricted (to be short). Similarly to the problem (1), if the die height value is set to be small, the overload occurs. In order to suppress this, the die height value is finely adjusted. As a result, a material to be pressed is locked only in the extreme vicinity of the press bottom dead center (bodies of the slide, the die (upper die part-lower die part), and the bolster are brought into contact), and hence the pressure-application time is restricted to be short.

(3) The action of restricting the overload acting on the die and the machine may be delayed. Energy may be lost at the time of such restriction. The overload cannot be restricted for each slide position (height). Even if the overload can be restricted for each slide position, the number of slide strokes (shots per minute) may be limited. As a result of such restriction, the operation of the press machine may be abnormally stopped.

In general (in most mechanical presses), the in-slide cylinder/hydraulic pressure chamber is provided with a relief valve (relief mechanism) for overload, prevention. If an overload occurs, the pressure (of the hydraulic pressure chamber) generated in proportion to the overload is removed by the relief valve by an amount corresponding to the overload. Unfortunately, the relief valve generally has a structure in which the valve closed by a spring force is opened by a larger pressure force corresponding to the overload, and hence there is a delay in time required for a response from the mechanism, until the relief valve is actually operated. The overload continues to act during the delay time. Further, when the relief valve is opened to release the pressure corresponding to the overload, the pressure oil (of the hydraulic pressure chamber) is discharged from a high-pressure side to a low-pressure side (such as a tank) via the relief valve (the pressure needs to be accumulated again at the time of recovery thereafter), and hence energy for the recovery is lost. Still further, the load capacity of the mechanical press machine becomes lower as the slide position becomes higher. Meanwhile, the pressure of the relief valve is generally set to be a constant (fixed) value, and is normally set so as to be suited to the maximum load capacity at the bottom dead center. Accordingly, if an overload occurs when the slide position is high, the function expected as the overload prevention mechanism cannot be fulfilled, leading to breakage of the machine and the die.

Against this problem, in the overload preventing apparatus for the mechanical press described in Japanese Patent Application Laid-Open No. 2001-1199, the set overload pressure is changed along the press capacity curve (in accordance with the slide position (height)), whereby even if an overload occurs when the slide position is high, the overload can be properly prevented. However, if the relief valve is operated due to the overload, the pressure oil in the hydraulic pressure chamber is relieved (discharged) (an enormous amount of oil is discharged), with the result that the operation of the press machine is forced to once stop abnormally. In addition, the die height value that has caused the overload needs to be adjusted.

That is, the invention described in Japanese Patent Application Laid-Open No. 2001-1199 is not intended to control the pressure of the hydraulic pressure chamber provided in the slide of the mechanical press, but relates to the overload preventing apparatus that simply prevents the overload from acting on the mechanical press. Accordingly, the invention described in Japanese Patent Application Laid-Open No. 2001-1199 cannot solve the problems (1) and (2). Although the invention can prevent breakage of the machine and the die, the invention cannot avoid the relief operation at the time of overload prevention.

According to the invention described in Japanese Patent Application Laid-Open No. 08-118083, even if the die height value is set to be small, the elastic action of the accumulator prevents an overload from occurring when a material to be pressed is locked between the slide (upper die part) and the bolster (lower die part). In addition, because hydraulic actuation is adopted, the pressure-application holding time at the bottom dead center can be lengthened. However, the accumulator is provided to a hydraulic control circuit of the overload protector, resulting in the occurrence of a phenomenon similar to that when the rigidity of a press frame is reduced. That is, a breakthrough phenomenon that occurs when energy of the pressure oil accumulated in the accumulator is suddenly released at the end of pressure application (at the time of elastic recovery) becomes more significant. In addition, the invention described in Japanese Patent Application Laid-Open No. 08-118083 cannot solve the problem (3).

According to the invention described in Japanese Patent Application Laid-Open No. 06-155088, the stroke possible range of a piston of the hydraulic cylinder can be varied by a slide initial position adjustment mechanism and the supply and discharge of the hydraulic oil to and from the hydraulic pressure chamber of the hydraulic cylinder, and the applied pressure is held with the slide being maintained at the bottom dead center position. The hydraulic oil is discharged from a cylinder portion of the hydraulic cylinder into an oil tank such that the slide is maintained at the bottom dead center position and an overload state is prevented, while the discharge speed is adjusted by a function of a throttle valve (paragraph [0016] of Japanese Patent Application Laid-Open No. 06-155088). After that, the hydraulic oil is supplied during moving up of the slide, whereby the stroke possible range (strokable range) is widened again.

As described above, the invention described in Japanese Patent Application Laid-Open No. 06-155088 is not intended to control the pressure of the hydraulic pressure chamber provided in the slide of the mechanical press, but the hydraulic oil in the hydraulic pressure chamber of the hydraulic cylinder is relieved in order to maintain the slide at the bottom dead center position, and all the relieved pressure oil leads to energy loss. In addition, the invention described in Japanese Patent Application Laid-Open No. 06-155088 cannot solve the problem (3).

The presently disclosed subject matter has been made in view of the above-mentioned circumstances, and therefore has an object to provide a press load controlling apparatus for a mechanical press capable of solving all the above-mentioned problems, that is, capable of: saving the trouble of strictly adjusting a die height value; lengthening pressure-application time in the vicinity of a bottom dead center; preventing a breakthrough phenomenon from occurring at the end of pressure application; and restricting a press load before the occurrence of an overload, thus avoiding the interruption of a press operation.

In order to achieve the above-mentioned object, a press load controlling apparatus for a mechanical press according to a first aspect of the presently disclosed subject matter includes: a cylinder-piston mechanism provided in a slide of the mechanical press; a relief valve that acts when a pressure of a hydraulic pressure chamber of the cylinder-piston mechanism exceeds a set overload pressure; a hydraulic pump/motor connected to the hydraulic pressure chamber of the cylinder-piston mechanism; an electric servomotor connected to a rotating shaft of the hydraulic pump/motor; a pressure detecting device that detects the pressure of the hydraulic pressure chamber of the cylinder-piston mechanism; a pressure commanding device that commands the pressure of the hydraulic pressure chamber on a basis of a preset press load command; and a controlling device that controls a torque of the electric servomotor on a basis of a pressure command from the pressure commanding device and the pressure detected by the pressure detecting device, to thereby control the pressure of the hydraulic pressure chamber of the cylinder-piston mechanism.

With the press load controlling apparatus for a mechanical press according to the first aspect, the pressure of the hydraulic pressure chamber of the cylinder-piston mechanism provided in the slide of the mechanical press cat be variably controlled with a high responsiveness by the hydraulic pump/motor driven by the electric servomotor. Accordingly, even if the die height value is set to a value small enough to cause an overload, the press load can be restricted before the occurrence of the overload, and this can save the trouble of strictly adjusting the die height value. Further, because the pressure of the hydraulic pressure chamber of the cylinder-piston mechanism can be controlled, the pressure-application time in the vicinity of the bottom dead center can be lengthened, and the breakthrough phenomenon can be suppressed from occurring at the end of pressure application. Still further, because the overload does not occur, a pressure liquid in the hydraulic pressure chamber of the cylinder-piston mechanism is not relieved, so that the interruption of the press operation is avoided. Note that, the relief valve is not used during pressure control, and simply functions as a safety valve, resulting in no energy loss due to the pressure control.

A press load controlling apparatus for a mechanical press according to a second aspect of the presently disclosed subject matter includes: a plurality of cylinder-piston mechanisms provided in a slide of the mechanical press; a plurality of relief valves that act when pressures of hydraulic pressure chambers of the plurality of cylinder-piston mechanisms each exceed a set overload pressure; a plurality of hydraulic pump/motors respectively connected to the hydraulic pressure chambers of the plurality of cylinder-piston mechanisms; a plurality of electric servomotors respectively connected to rotating shafts of the plurality of hydraulic pump/motors; a plurality of pressure detecting devices that respectively detects the pressures of the hydraulic pressure chambers of the plurality of cylinder-piston mechanisms; a pressure commanding device that commands the pressures of the hydraulic pressure chambers on a basis of a preset press load command; and a controlling device that controls torques of the plurality of electric servomotors on a basis of a pressure command from the pressure commanding device and the pressures respectively detected by the plurality of pressure detecting devices, to thereby control the pressures of the hydraulic pressure chambers of the plurality cylinder-piston mechanisms.

With the press load controlling apparatus for a mechanical press according to the second aspect, the plurality of cylinder-piston mechanisms are provided in the slide of the mechanical press, and the pressures of the hydraulic pressure chambers of the cylinder-piston mechanisms are each controlled. Accordingly, an eccentric press load can be prevented from being applied even if the slide has a large size.

According to a third aspect of the presently disclosed subject matter, in the press load controlling apparatus for a mechanical press according to the first or second aspect, the hydraulic pump/motor eludes a plurality of hydraulic pump/motors connected in parallel to one hydraulic pressure chamber of the cylinder-piston mechanism, the electric servomotor includes a plurality of electric servomotors respectively connected to rotating shafts of the plurality of hydraulic pump/motors connected in parallel, and the controlling device controls torques of the plurality of electric servomotors connected in parallel according to the pressure command from the pressure commanding device and the pressure detected by the pressure detecting device, to thereby control the pressure of the hydraulic pressure chamber of the cylinder-piston mechanism. Accordingly, even the case where the supply amount of the pressure liquid to the hydraulic pressure chamber of the cylinder-piston mechanism is large can be dealt with.

According to a fourth aspect of the presently disclosed subject matter, the press load controlling apparatus for a mechanical press according to any one of the first to third aspects, further includes a regenerating device that supplies power of a pressure liquid as electrical energy back to a power supply via the hydraulic pump/motor and the electric servomotor, the power being generated when the pressure of the hydraulic pressure chamber of the cylinder-piston mechanism is reduced.

Pressure application and pressure reduction are alternately repeated in the hydraulic pressure chamber of the cylinder-piston mechanism, and energy consumed for the pressure application can be regenerated for the pressure reduction, so that an energy-efficient apparatus can be obtained.

According to a fifth aspect of the presently disclosed subject matter, the press load controlling apparatus for a mechanical press according to any one of the first to fourth aspects, further includes an angular velocity detector that detects a rotation angular velocity of the electric servomotor. The controlling device uses the angular velocity detected by the angular velocity detector as angular velocity feedback for securing dynamic stability of the pressure.

According to a sixth aspect of the presently disclosed subject matter, the press load controlling apparatus for a mechanical press according to any one of the first to fifth aspects, further includes an angle detector that detects a crank angle of a crank of the mechanical press. The pressure commanding device commands the pressure of the hydraulic pressure chamber using one of the crank angle detected by the angle detector and a slide position of the slide calculated from the crank angle.

According to a seventh aspect of the presently disclosed subject matter, the press load controlling apparatus for a mechanical press according to any one of the first to fifth aspects, further includes a slide position detector that detects a slide position of the slide of the mechanical press. The pressure commanding device commands the pressure of the hydraulic pressure chamber using the slide position of the slide detected by the slide position detector.

According to an eighth aspect of the presently disclosed subject matter, in the press load controlling apparatus for a mechanical press according to the sixth or seventh aspect, the pressure commanding device commands the pressure of the hydraulic pressure chamber along an allowable pressure-application capacity curve using the slide position of the slide, and commands, in a vicinity of a bottom dead center of the slide, the pressure of the hydraulic pressure chamber along a constant value equal to or less than the allowable pressure-application capacity curve in order to secure shaping performance. According y, the pressure can be applied for a relatively long time, and a definitive pressing effect for stabilizing a product shape can be obtained.

According to a ninth aspect of the presently disclosed, subject matter, the press load controlling apparatus for a mechanical press according to any one of the first to eighth aspects, further includes: an angular velocity detector that detects a crank angular velocity of a crank of the mechanical press; and an angle detector that detects a crank angle of the crank of the mechanical press. The controlling device uses a slide velocity calculated from the crank angular velocity detected by the angular velocity detector and the crank angle detected by the angle detector, for compensating pressure control of the hydraulic pressure chamber.

According to a tenth aspect of the presently disclosed subject matter, the press load controlling apparatus for a mechanical press according to any one of the first to eighth aspects, further includes a slide velocity detector that detects a slide velocity of the slide of the mechanical press. The controlling device uses the slide velocity detected by the slide velocity detector, for compensating pressure control of the hydraulic pressure chamber.

According to an eleventh aspect of the presently disclosed subject matter, the press load controlling apparatus for a mechanical press according to any one of the first to tenth aspects, further includes: a slide position detector that detects a slide position of the slide of the mechanical press; and an angle detector that detects a crank angle of a crank of the mechanical press. The controlling device uses a cylinder position of the cylinder-piston mechanism calculated from the slide position detected by the slide position detector and the crank angle detected by the angle detector, for compensating the pressure control of the hydraulic pressure chamber.

According to a twelfth aspect of the presently disclosed subject matter, the press load controlling apparatus for a mechanical press according to any one of the first to tenth aspects, further includes a cylinder position detector that detects a cylinder position of the cylinder-piston mechanism. The controlling device uses the cylinder position detected by the cylinder position detector, for compensating the pressure control of the hydraulic pressure chamber.

According to the presently disclosed subject matter, the pressure of the hydraulic pressure chamber of the cylinder-piston mechanism provided in the slide of the mechanical press can be variably controlled with a high responsiveness, and hence the following effects can be obtained. That is, even if the die height value is set to a value small enough to cause an overload, the press load can be restricted before the occurrence of the overload, and this can save the trouble of strictly adjusting the die height value. Further, the pressure-application time in the vicinity of the bottom dead center can be lengthened, and the breakthrough phenomenon can be suppressed from occurring at the end of pressure application. Still further, because the overload does not occur, the pressure liquid in the hydraulic pressure chamber of the cylinder-piston mechanism is not relieved, so that the interruption of the press operation is avoided.

DETAILED DESCRIPTION OF THE PREFERRED EMBODIMENTS

Hereinafter, preferred embodiments of a press load controlling apparatus for a mechanical press according to the presently disclosed subject matter are described in detail with reference to the attached drawings.

Configuration of Press Load Controlling Apparatus for Mechanical Press

First Embodiment

Structure of Mechanical Press

Figure 1:
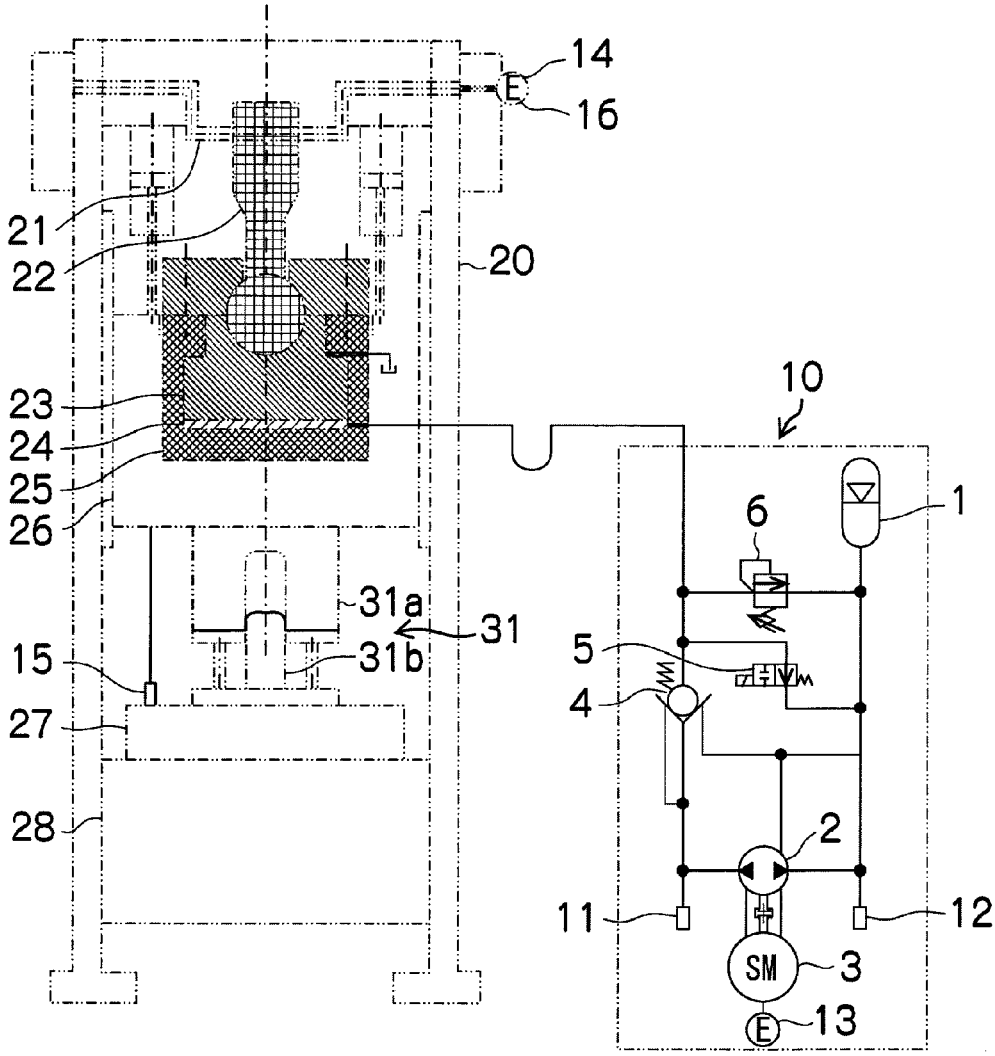
FIG. 1 is a configuration diagram illustrating a first embodiment of a press load controlling apparatus for a mechanical press according to the presently disclosed subject matter.

FIG. 1 is a configuration diagram illustrating a first embodiment of the press load controlling apparatus for the mechanical press according to the presently disclosed subject matter.

The mechanical press illustrated in FIG. 1 includes a column (frame) 20, a slide 26, and a bolster 27 placed on a bed 28, and the slide 26 is movably guided in the vertical direction by a guide unit provided to the column 20. The slide 26 is moved by a crank mechanism in the top-bottom direction of FIG. 1, and the crank mechanism includes: a crankshaft 21 to which a rotary driving force is transmitted by a driving device (not illustrated); a connecting rod 22; and a cylinder-piston mechanism provided in the slide 26 (an in-slide cylinder 25 and an in-slide piston 23). Note that, reference numeral 24 designates a hydraulic pressure chamber of the cylinder-piston mechanism.

A slide position detector 15 that detects the position of the slide 26 is provided on the bolster 27 side of the mechanical press, and an angular velocity detector 14 and an angle detector 16 that respectively detect the angular velocity and the angle of the crankshaft 21 are provided to the crankshaft 21. Note that, the angular velocity detector 14 may differentiate an angle signal outputted from the angle detector 16 to thereby acquire an angular velocity signal.

An upper die part 31*a* is fixed to the slide 26, and a lower die part 31*b* is fixed to the bolster 27. A die 31 (the upper die part 31*a* and the lower die part 31*b*) of the present embodiment is used for shaping a hollow cup-like (drawn) product with a closed top.

The structure of the mechanical press described above is a general example.

<Hydraulic Circuit of Press Load Controlling Apparatus>

A hydraulic circuit 10-1 (corresponding to a hydraulic circuit 10 in FIG. 1) in the press load controlling apparatus according to the presently disclosed subject matter mainly includes an accumulator 1, a hydraulic pump/motor 2, an electric servomotor 3 connected to a rotating shaft the hydraulic pump/motor 2, a pilot operated check valve 4, a solenoid valve 5, and a relief valve 6.

A gas pressure of approximately 1 to 5 kg/cm$^2$ is set to the accumulator 1. The accumulator 1 accumulates therein hydraulic oil in a low-pressure (substantially constant low-pressure) state of approximately 10 kg/cm$^2$ or lower, and serves as a tank.

One port of the hydraulic pump/motor 2 is connected to the hydraulic pressure chamber 24 via the pilot operated check valve 4, and another port thereof is connected to the accumulator 1. The hydraulic pump/motor 2 rotates in a forward direction (a direction in which the pressure of the hydraulic pressure chamber 24 is increased) or in a reverse direction (a direction in which the pressure of the hydraulic pressure chamber 24 is reduced) in accordance with a torque given from the electric servomotor 3 and hydraulic pressures acting on both the ports.

In a region of a non-processing step (at least the upper half of a slide stroke) in one cycle of the press (slide) operation, in order to reduce a load on the electric servomotor 3 (and the hydraulic pump/motor 2), the pilot operated check valve 4 enables the pressure of the hydraulic pressure chamber 24 to be constantly held even when the electric servomotor 3 is in a no-load state (no-torque state). The pressure acting on the port of the hydraulic pump/motor 2 on the hydraulic pressure chamber side is used for pilot operation.

Accordingly, when no load is applied to the electric servomotor 3, the pressure acting on the port of the hydraulic pump/motor 2 on the hydraulic pressure chamber side is reduced, the pilot operated check valve 4 is closed, and the pressure of the hydraulic pressure chamber 24 is held. Conversely, when a load is applied to the electric servomotor 3, the pilot operated check valve 4 is opened. In a processing region (at most, the lower half of the slide stroke), a load is applied to the electric servomotor 3, whereby the pressure of the hydraulic pressure chamber 24 is controlled.

The solenoid valve 5 serves to forcibly reduce the pressure acting on the hydraulic pressure chamber 24. The solenoid valve 5 is not used in a normal operation (when the machine is working), but is used at the time of maintenance (before taking the machine apart to pieces).

The relief valve 6 serves to release the pressure oil to the substantially constant low-pressure (accumulator 1) side if an unexpected abnormal pressure acts on the hydraulic pressure chamber 24 differently from the pressure intentionally controlled. In the presently disclosed subject matter, an overload prevention mechanism (function) is provided separately from the relief valve 6 (is implemented by the electric servomotor 3 and the hydraulic pump/motor 2), and hence the relief valve 6 functions as a safety valve for protecting the apparatus in the worst case.

Note that, the pressure acting on the port of the hydraulic pump/motor 2 on the hydraulic pressure chamber side (the pressure of the hydraulic pressure chamber 24 when the pilot operated check valve 4 is opened) is detected by a pressure detector 11, and the pressure acting on the port of the hydraulic pump/motor 2 on the accumulator side is detected by a pressure detector 12. In addition, the angular velocity of the electric servomotor 3 is detected by an angular velocity detector 13.

<Principle of Pressure Control of In-Slide Hydraulic Pressure Chamber>

The control of the press load can be performed by controlling the pressure of the in-slide hydraulic pressure chamber 24 (that is, the torque of the hydraulic pump/motor 2).

Hereinafter, the principle of the pressure control of the hydraulic pressure chamber 24 is described.

Here, respective elements are defined as follows.

Cross-sectional area of in-slide cylinder 25 (hydraulic pressure chamber 24): A Volume of in-slide cylinder 25 (hydraulic pressure chamber 24): V Pressure of hydraulic pressure chamber 24: P Torque of electric servomotor 3: T Moment of inertia of electric servomotor 3: I Viscous drag coefficient of electric servomotor 3: $D_M$ Friction torque of electric servomotor 3: $f_M$ Displacement quantity of hydraulic pump/motor 2: Q Force applied to in-slide cylinder 25 by slide 26: F Compression velocity of in-slide cylinder 25: v Mass of in-slide cylinder 25 (linked to slide): M Viscous drag coefficient of in-slide cylinder 25: $D_S$ Friction force of in-slide cylinder 25: $f_S$ Angular velocity of electric servomotor 3: ω

Bulk modulus of elasticity of hydraulic oil: K

Proportionality constants: $k_1$, $k_2$

When a press load F acts on the in-slide cylinder 25 via the slide 26 from the state where a pressure P of the in-slide cylinder 25 is $P_0$, the following [Expression 1] to [Expression 3] are established.

$$P=P_0+\int K\{(v\cdot A-k_1Q\cdot\omega)/V\}dt \quad \text{[Expression 1]}$$

$$F-P\cdot A=M\cdot dv/dt+D_S\cdot v+f_S \quad \text{[Expression 2]}$$

$$k_2\cdot PQ/(2\pi)-T=I\cdot d\omega/dt+D_M\cdot\omega+f_M \quad \text{[Expression 3]}$$

The force transmitted to the in-slide cylinder 25 via the slide 26 compresses the in-slide cylinder 25 linked to the slide 26, to thereby bring a change to the pressure (increase or reduction) (the second term in the right side of [Expression 1]),

[Expression 2] and [Expression 3] each represent an equation of motion of a unit formed of the in-slide cylinder 25 (mass linked) and the electric servomotor 3 (inertia linked).

The torque T of the electric servomotor 3 is controlled such that the pressure change amount in the right side of [Expression 1] is made 0 irrespective of the compression amount and compression velocity of the in-slide cylinder 25, whereby the pressure P of the hydraulic pressure chamber 24 can be cat oiled in accordance with (along) a target value Pr.

At this time, in order to stably control the pressure of the hydraulic pressure chamber 24 according to the set value, the pressure P, the motor angular velocity a), the slide velocity, or the cylinder compression velocity v is detected and calculated to be used as compensation for calculating and determining the operation-side motor torque T. In addition, the slide position is detected to be used as a commanding device for the pressure. In addition, the cylinder position that is obtained by direct detection or calculation of a plurality of detected signals is used as a compensating device for the pressure control.

<Control Unit of Press Load Controlling Apparatus>

Figure 2:
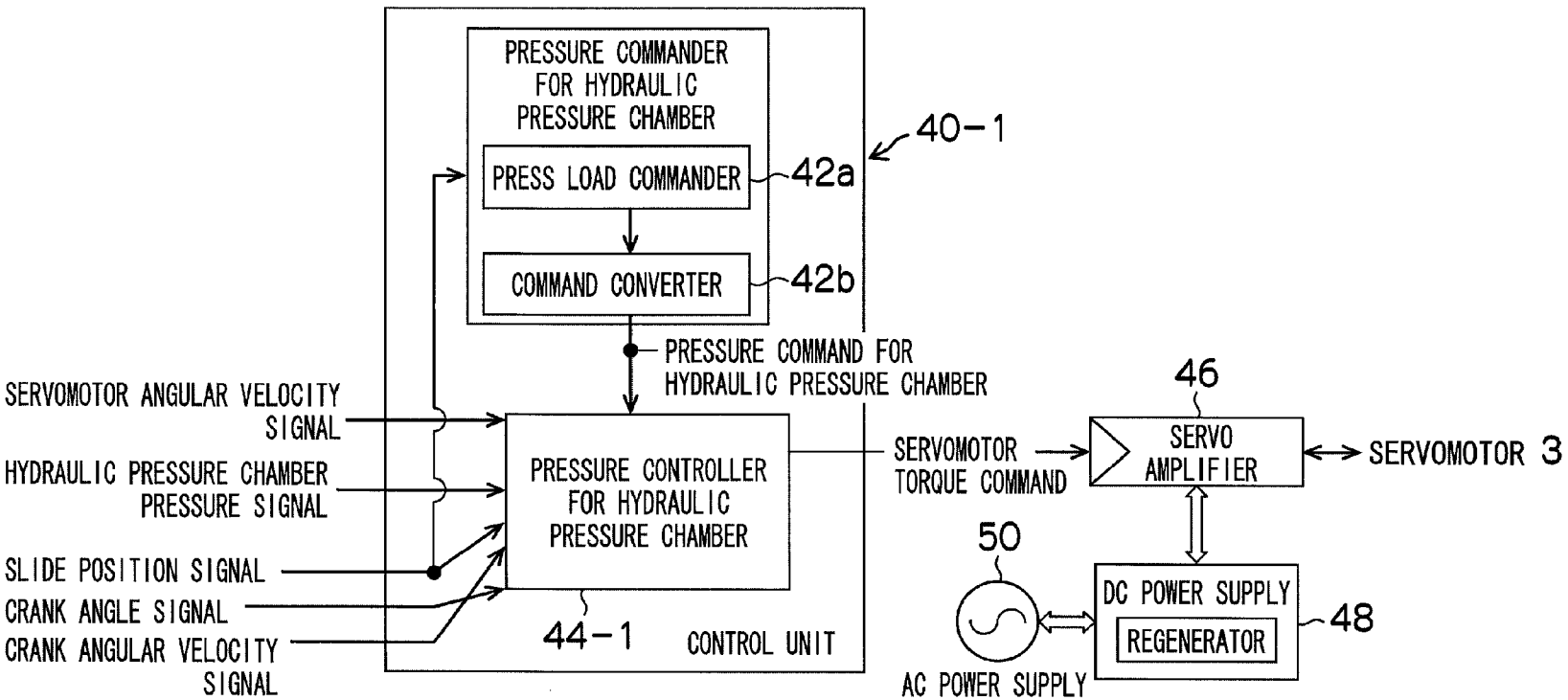
FIG. 2 is a block diagram illustrating a control unit in the press load controlling apparatus for the mechanical press illustrated in FIG. 1.

FIG. 2 is a block diagram illustrating a control unit in the press load controlling apparatus for the mechanical press illustrated in FIG. 1.

As illustrated in FIG. 2, a control unit 40-1 mainly includes: a pressure commander 42 that commands the pressure of the in-slide hydraulic pressure chamber 24; and a pressure controller 44-1 that controls the pressure of the hydraulic pressure chamber 24.

The pressure commander 42 includes a press load commander 42*a* and a command converter 42*b*, and a press load command according to the position of the slide 26 is set in advance in the press load commander 42*a*. Then, the press load commander 42*a* outputs, to the command converter 42*b*, the press load command corresponding to the slide position on the basis of a slide position signal indicating the position of the slide 26, the slide position signal being received from the slide position detector 15. The command converter 42*b* converts the press load command received from the press load commander 42*a* into a pressure command of the hydraulic pressure chamber 24, and outputs the pressure command to the pressure controller 44-1.

Further, the input to the pressure controller 44-1 includes: an angular velocity signal indicating the angular velocity of the electric servomotor 3 from the angular velocity detector 13; a pressure signal indicating the pressure of the hydraulic pressure chamber 24 from the pressure detector 11; the slide position signal indicating the position of the slide from the slide position detector 15; a crank angular velocity signal indicating the crank angular velocity from the angular velocity detector 14; and a crank angle signal indicating the angle from the angle detector 16. The pressure controller 44-1 calculates and determines a torque command for controlling the torque of the electric servomotor 3 on the basis of the pressure command supplied from the pressure commander 42 and the signals detected by the respective detectors. The pressure controller 44-1 outputs the determined torque command to the electric servomotor 3 via a servo amplifier 46, to thereby perform such control that the pressure of the hydraulic pressure chamber 24 becomes a target value (the pressure indicated by the pressure command).

In addition, when the pressure of the hydraulic pressure chamber 24 is reduced, the rotating shaft torque generated in the hydraulic pump/motor 2 exceeds the driving torque of the electric servomotor 3, and the hydraulic pump/motor 2 acts as a hydraulic motor to rotate the electric servomotor 3 (regenerative action). Electric power generated by the regenerative action of the electric servomotor 3 is supplied back to an AC power supply 50 via the servo amplifier 46 and a DC power supply 48 with an electric power regenerating function.

Note that, although not illustrated in FIG. 2, a pressure signal is supplied to the pressure controller 44-1 from the pressure detector 12 that detects the pressure acting on the port of the hydraulic pump/motor 2 on the accumulator side. This makes it possible to detect oil leakage from the hydraulic circuit 10 and detect the torque of the hydraulic pump/motor 2, eventually, the torque of the electric servomotor 3 on the basis of a difference between the pressure acting on the port of the hydraulic pump/motor 2 on the hydraulic pressure chamber side (the pressure of the hydraulic pressure chamber) and the pressure acting on the port thereof on the accumulator side.

<Description of Steps Using Operation Waveforms>

Figure 3A:
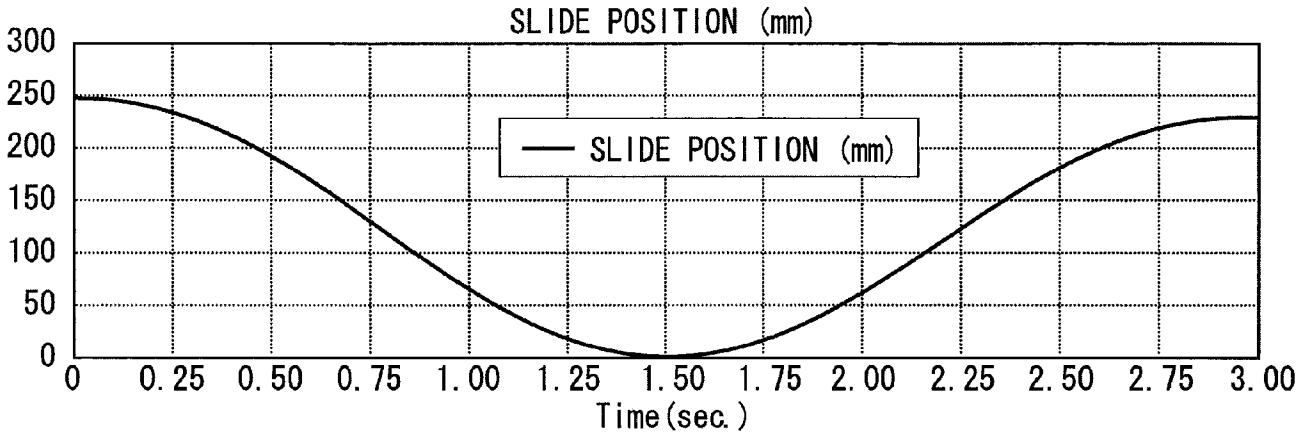
FIG. 3A is a waveform chart illustrating a change of a slide position when a slide of the mechanical press is operated in one cycle.
Figure 3B:
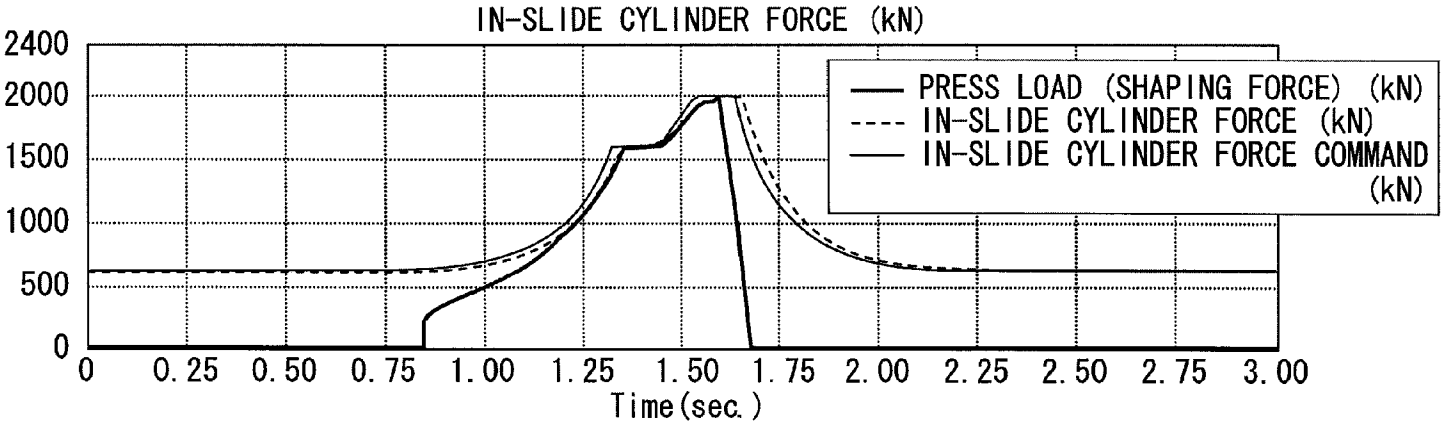
FIG. 3B is a waveform chart illustrating changes of respective physical amounts of a press load (shaping force), an in-slide cylinder force command, and a cylinder force along with the change of the slide position when the slide of the mechanical press is operated in one cycle.
Figure 4A:
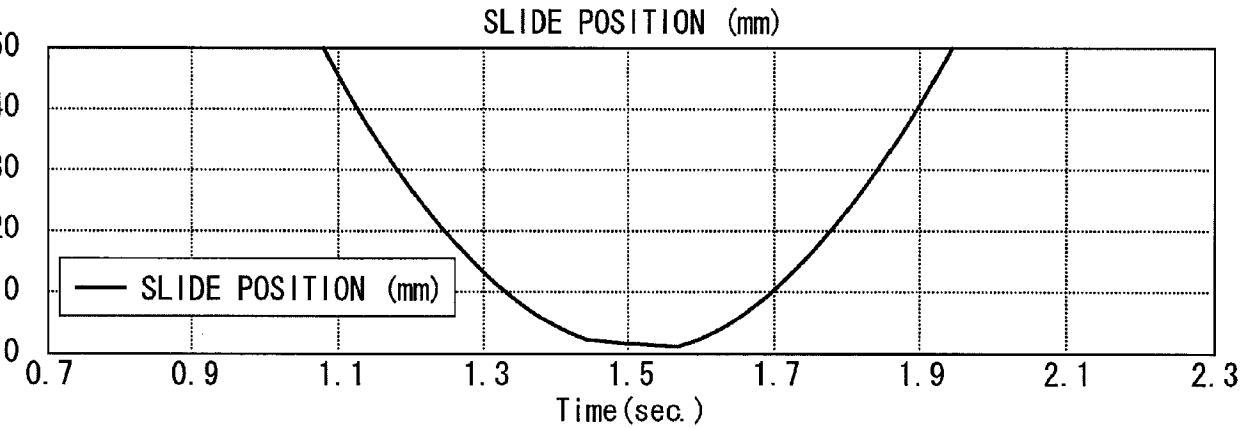
FIG. 4A is an enlarged chart of a main part in the vicinity of a bottom dead center of the slide, which is taken from the waveform chart illustrated in FIG. 3A.
Figure 4B:
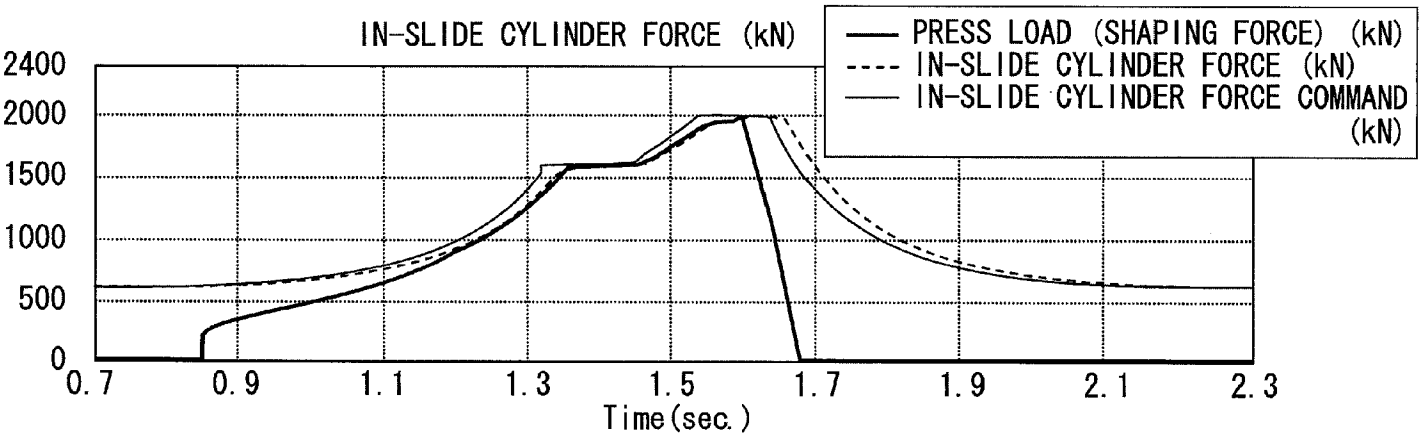
FIG. 4B is an enlarged chart of a main part in the vicinity of the bottom dead center of the slide, which is taken from the waveform chart illustrated in FIG. 3B.

FIGS. 3A and 3B are waveform charts respectively illustrating a change of a slide position and changes of respective physical amounts of a press load (shaping force), an in-slide cylinder force command, and a cylinder force along with the change of the slide position when the slide of the mechanical press is operated in one cycle according to a basic action example of the presently disclosed subject matter. FIGS. 44 and 4B are enlarged charts of main parts in the vicinity of the bottom dead center of the slide, which are taken from the waveform charts respectively illustrated in FIGS. 3A and 3B. Note that, an in-slide cylinder force is obtained by multiplying the hydraulic pressure of the hydraulic pressure chamber 24 by the pressure applied area of the cylinder.

[A: Non-Processing Step]

In a non-processing region (in the present embodiment, the upper half of the stroke of the slide 26; 0 to 0.75 s and 2.25 to 3 s on the waveforms) including the top dead center of the slide 26, the electric servomotor 3 is brought into the no-load state (no-torque state), and the in-slide cylinder force is generated by holding the pressure of the hydraulic pressure chamber 24 by the pilot operated check valve 4.

[B: Processing Step/Early Stage (When the Slide Position is Relatively High)]

In a processing region (in the present embodiment, the lower half of the slide stroke; 0.75 s to 2.25 s on the waveforms), the electric servomotor 3 is driven, and the hydraulic pressure of the hydraulic pressure chamber 24 is controlled along an allowable pressure-application capacity curve according to the slide position, basically for the purpose of overload prevention. That is, the press load commander 42*a* illustrated in FIG. 2 generates the press load command corresponding to the in-slide cylinder force command on the basis of the slide position signal (so that the hydraulic pressure changes in accordance with the allowable pressure-application capacity curve), and the command converter 42*b* illustrated in FIG. 2 converts the generated press load command into the pressure command of the hydraulic pressure chamber 24 to output the converted command to the pressure controller 44-1. The pressure controller 44-1 controls the torque of the electric servomotor 3 on the basis of the pressure command, the pressure signal of the hydraulic pressure chamber 24 and other detected signals, to thereby control the pressure of the hydraulic pressure chamber 24 so as to follow the pressure command.

At this time, the pressure signal to be controlled and the angular velocity signal e electric servomotor 3 and a slide velocity signal for maintaining dynamic stability are used. In addition, the cylinder position is used for compensating the pressure control. In this manner, the cylinder force is (variably) controlled along the allowable pressure-application capacity curve specific to the mechanical press. In the course of the control, the press load (shaping force) starts acting at a time point at which 0.85 s has passed. At this time point, the press load is smaller than the cylinder force, and hence the stroke of the in-slide cylinder 25 reaches its limit (the in-slide cylinder 25 is extended to the maximum).

[C: Processing Step/Middle Stage (when the Press Load (Shaping Force) is to Exceed the Allowable Pressure-Application Capacity Curve)]

Around 1.25 s, the press load shows a tendency to surpass (exceed) the cylinder force, while the cylinder force still continues to be controlled by the force along the allowable pressure-application capacity curve. As a result, the press load is restricted by the cylinder force and does not act any more. At this time, the in-slide cylinder 25, which is pushed by the press load, performs a slight amount of stroke (compression). Further, at this time, the electric servomotor 3 is rotated (regenerative action) by the pressure oil discharged from the hydraulic pressure chamber 24 via the hydraulic pump/motor 2, and the electric power generated by the regenerative action of the electric servomotor 3 is supplied back to the AC power supply 50 via the servo amplifier 46 and the DC power supply 48 with the electric power regenerating function.

[D: Processing Step/Last Stage (Press Load Control for Securing Shaping Performance in the Vicinity of the Bottom Dead Center)]

When the slide 26 is further moved down and the slide position becomes 10 mm (when 1.3 s has passed), in the present embodiment, in order to prevent a product (material) from being suddenly deformed (in order to secure the shaping performance), the cylinder force is controlled to a constant value of 1,600 kN (with respect to the cylinder force along the basic allowable pressure-application capacity curve intended for overload suppression that has been performed since then). After that, the cylinder force is controlled so as to gradually increase and finally reach 2,000 kN. Such procedures are realized by the operation of the press load controlling: apparatus based on a cylinder force command similarly to the step C. During this period (1.35 s to 1.6 s), the cylinder force is controlled in order to secure the shaping performance. As a result, the in-slide cylinder 25 is compressed by approximately 3 mm or smaller, and the pressure can be applied for a relatively long time of 0.25 s. Accordingly, a definitive pressing effect for stabilizing a product shape can be obtained.

In addition, even if the mechanical press is extended by heat (the connecting rod 22 is extended, and then, the column 20 is extended) according to continuous operation time, because the pressure of the hydraulic pressure chamber 24 is controlled to a set pressure while the in-slide cylinder 25 is extended and contracted (makes a stroke), the shaping is optimally performed without an overload.

[E: Moving-Up Step]

From 1.6 s to 2.25 s, in order to actively suppress an overload (in order to continue the slide operation while suppressing the occurrence of the overload even if the overload is to be generated) similarly to the step B, the cylinder force is controlled along the allowable pressure-application capacity curve.

Configuration of Press Load Controlling Apparatus for Mechanical Press

Second Embodiment

Figure 5:
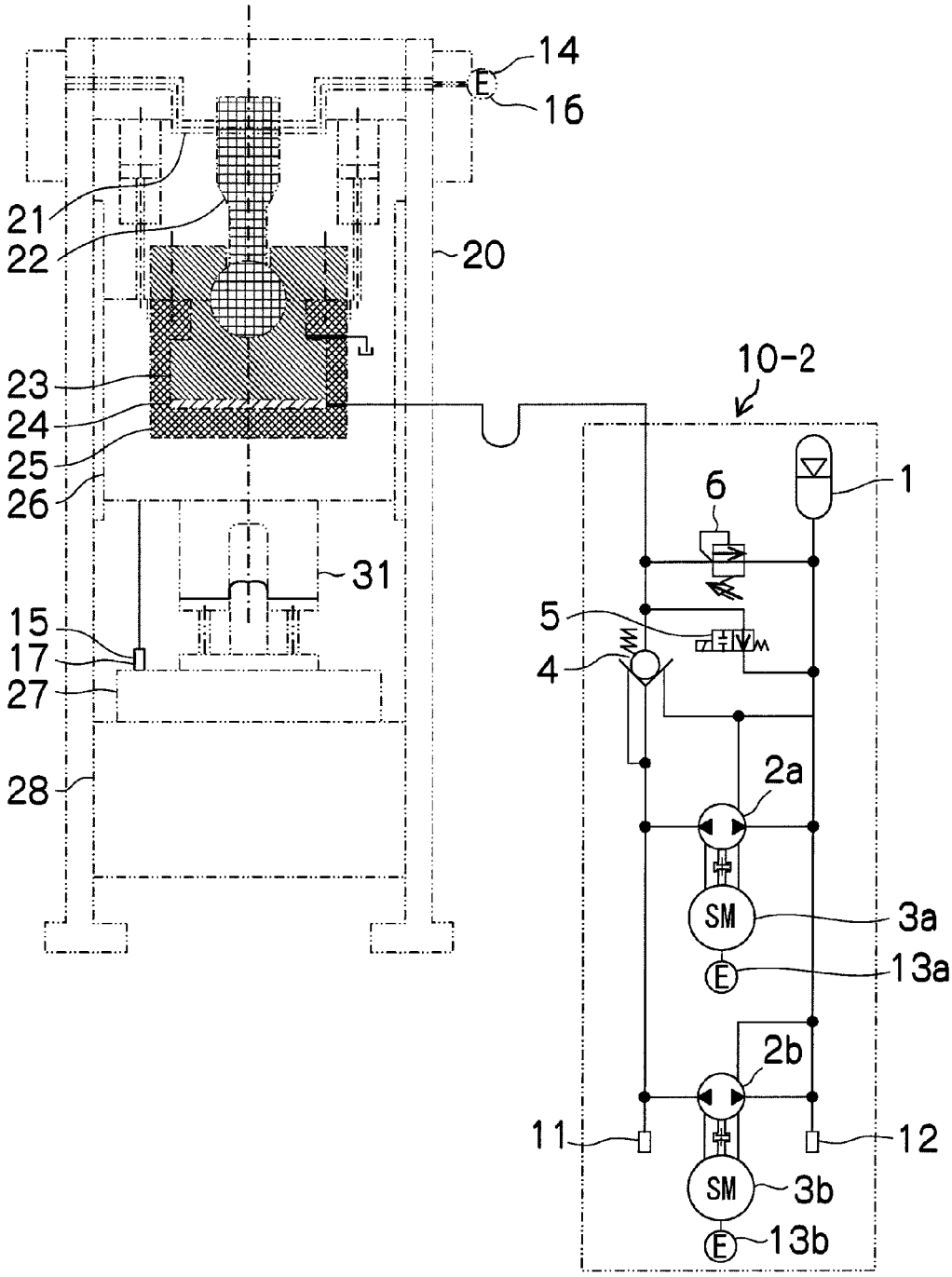
FIG. 5 is a configuration diagram illustrating a second embodiment of the press load controlling apparatus for the mechanical press according to the presently disclosed subject matter.
Figure 6:
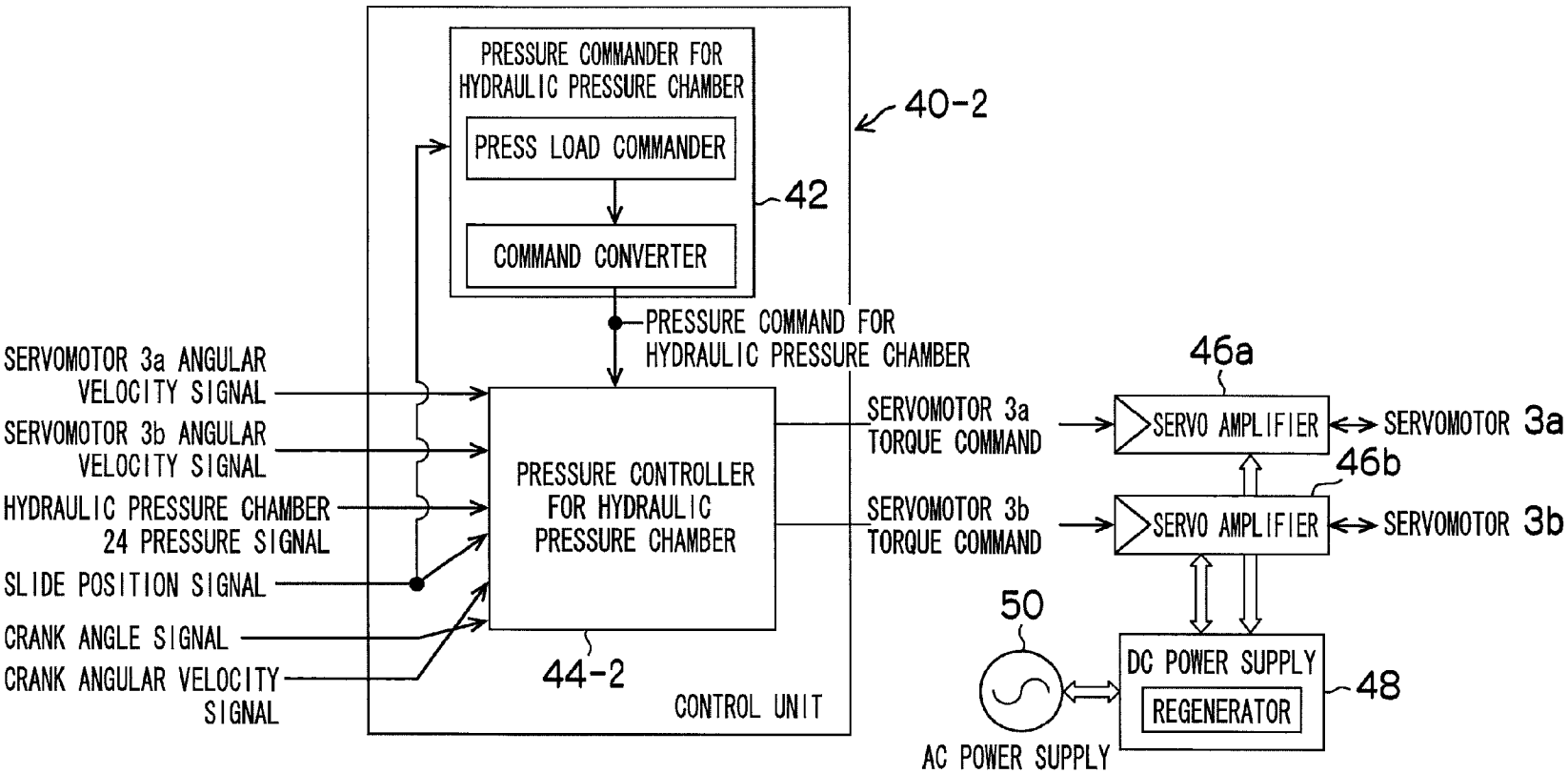
FIG. 6 is a block diagram illustrating a control unit in the press load controlling apparatus for the mechanical press illustrated in FIG. 5.

FIG. 5 is a configuration diagram illustrating a second embodiment of the press load controlling apparatus for the mechanical press according to the presently disclosed subject matter. FIG. 6 is a block diagram illustrating a control unit in the press load controlling apparatus for the mechanical press according to the second embodiment.

The press load controlling apparatus for the mechanical press according to the second embodiment illustrated in FIG. 5 and FIG. 6 is different mainly in that a hydraulic circuit 10-2 and a control unit 40-2 are provided instead of the hydraulic circuit 10 and the control it 40-1 in the press load controlling apparatus according to the first embodiment illustrated in FIG. 1 and FIG. 2. Note that, in FIG. 5 and FIG. 6, elements common to those of the first embodiment illustrated in FIG. 1 and FIG. 2 are designated by the same reference numerals and characters, and detailed description thereof will be omitted.

The hydraulic circuit 10-2 in the press load controlling: apparatus for the mechanical press according to the second embodiment illustrated in FIG. 5 is different mainly in that two sets of a hydraulic pump/motor and an electric servomotor (a hydraulic pump/motor 2*a* and an electric servomotor 3*a*, and a hydraulic pump/motor 2*b* and an electric servomotor 3*b*) are provided instead of one set of the hydraulic pump/motor 2 and the electric servomotor 3 according to the first embodiment.

The two hydraulic pump/motors 2*a*, 2*b* are connected in parallel between the hydraulic pressure chamber 24 and the accumulator 1. In addition, the electric servomotors 3*a*, 3*b* are respectively connected to rotating shafts of the hydraulic pump/motors 2*a*, 2*b*, and angular velocity detectors 13*a*, 13*b* are respectively provided to rotating shafts of the electric servomotors 3*a*, 3*b*.

The control unit 40-2 in the press load controlling apparatus for the mechanical press according to the second embodiment illustrated in FIG. 6 controls the torques of the two electric servomotors 3*a*, 3*b*, to thereby control the pressure of the hydraulic pressure chamber 24.

That is, a pressure controller 44-2 of the control unit 40-2 receives: angular velocity signals respectively indicating the angular velocities of the electric servomotors 3*a*, 3*b* from the angular velocity detectors 13*a*, 13*b*; the pressure signal indicating the pressure of the hydraulic pressure chamber 24 from the pressure detector 11; the slide position signal indicating the position of the slide from the slide position detector 15; the crank angular velocity signal indicating the crank angular velocity from the angular velocity detector 14; and the crank angle signal indicating the angle from the angle detector 16. The pressure controller 44-2 calculates and determines torque commands for controlling the torques of the electric servomotors 3*a*, 3*b* on the basis of the pressure command supplied from the pressure commander 42 and the signals detected by the respective detectors. The pressure controller 44-2 outputs the determined torque commands respectively to the electric servomotors 3*a*, 3*b* via servo amplifiers 46*a*, 46*b*, to thereby perform such control that the pressure of the hydraulic pressure chamber 24 becomes a target value (the pressure indicated by the pressure command).

In this way, the torque control of the electric servomotors 3*a*, 3*b* is performed in a manner similar to the torque control of the single electric servomotor 3 according to the first embodiment, but the capacity of each of the electric servomotors 3*a*, 3*b* can be reduced to one half the capacity of the single electric servomotor 3.

Note that, not limited to the two sets of the hydraulic pump/motor and the electric servomotor, three or more sets of the hydraulic pump/motor and the electric servomotor may be provided.

Configuration of Press Load Controlling Apparatus for Mechanical Press

Third Embodiment

Figure 7:
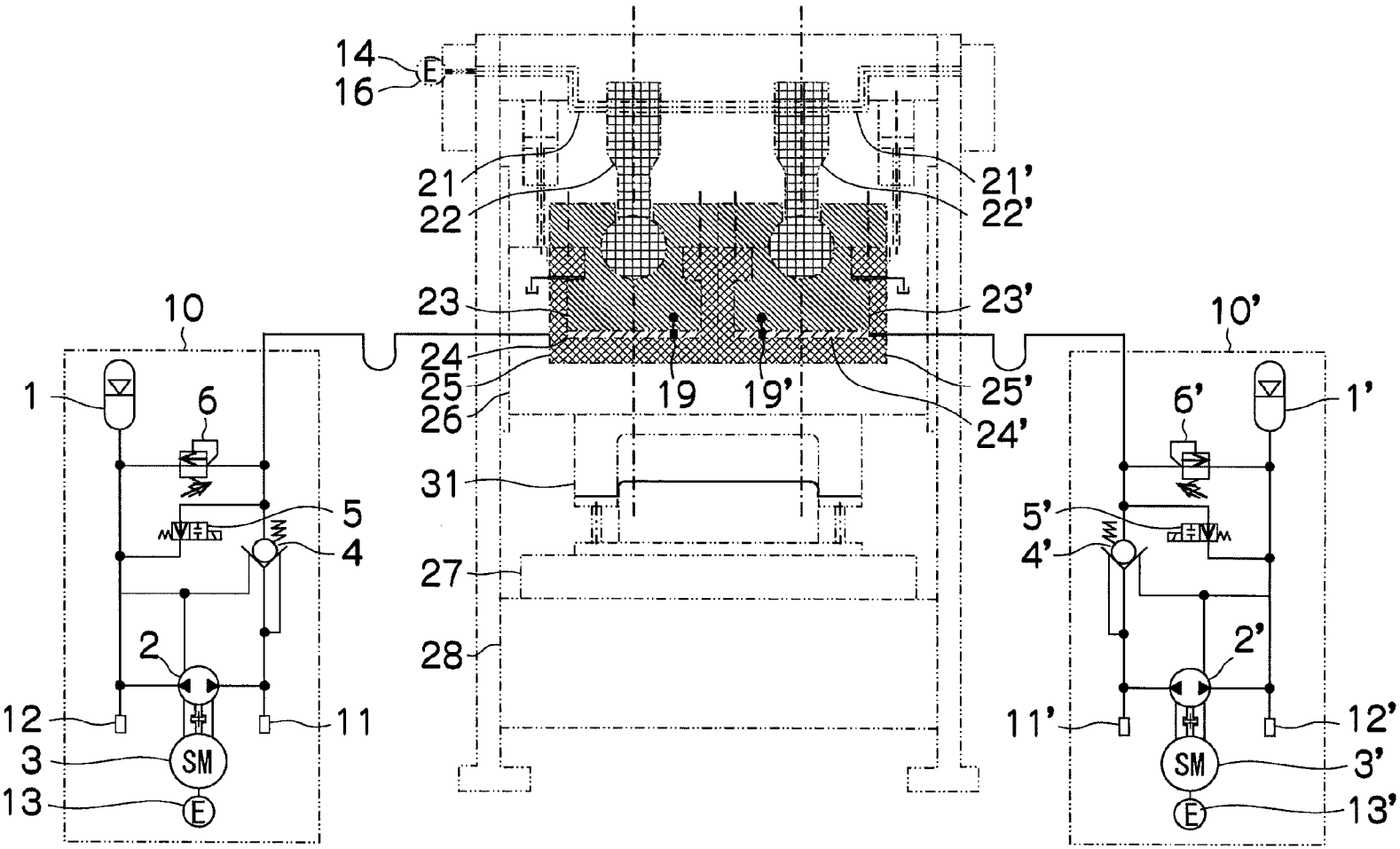
FIG. 7 is a configuration diagram illustrating a third embodiment of the press load controlling apparatus for the mechanical press according to the presently disclosed subject matter.
Figure 8:
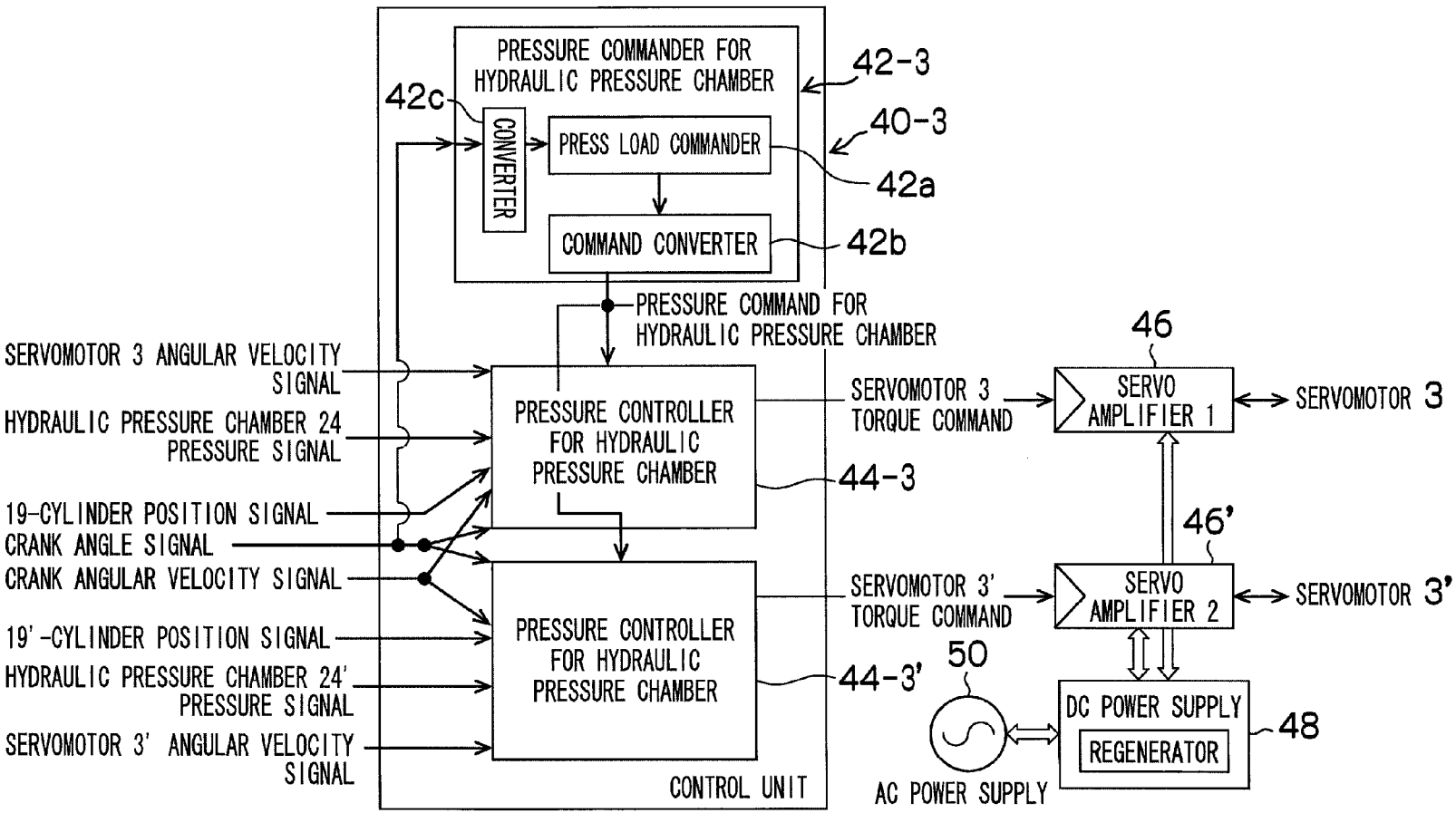
FIG. 8 is a block diagram illustrating a control unit in the press load controlling apparatus for the mechanical press illustrated in FIG. 7.

FIG. 7 is a configuration diagram illustrating a third embodiment of the press load controlling apparatus for the mechanical press according to the presently disclosed subject matter. FIG. 8 is a block diagram illustrating a control unit in the press load controlling apparatus for the mechanical press according to the third embodiment.

The press load controlling apparatus for the mechanical press according to the third embodiment illustrated in FIG. 7 and FIG. 8 is different from one system of the press load controlling apparatus according to the first embodiment illustrated in FIG. 1 and FIG. 2 mainly in that two systems of the press load controlling apparatus are left-right symmetrically provided.

Note that, in FIG. 7, elements common to those of the first embodiment illustrated in FIG. 1 are designated by the same reference numerals, and detailed description thereof will be omitted. In addition, reference numerals with apostrophe ['] designate equivalents of elements designated by reference numerals without an apostrophe, and the elements designated by the reference numerals without an apostrophe and the elements designated by the reference numerals with an apostrophe form the two systems of the press load controlling apparatus.

In the press load controlling apparatus for the mechanical press according to the third embodiment, a left-right pair of cylinder-piston mechanisms are provided in the slide of the mechanical press, whereby the pressures of hydraulic pressure chambers 24, 24' of the respective cylinder-piston mechanisms can be controlled. In addition, in the third embodiment, cylinder position detectors 19, 19' that respectively detect the cylinder positions of in-slide cylinders 25, 25' of the left-right pair of cylinder-piston mechanisms are provided.

A control unit 40-3 in the press load controlling apparatus according to the third embodiment illustrated in FIG. 8 controls the torques of a left-right pair of electric servomotors 3, 3', to thereby control the pressures of the hydraulic pressure chambers 24, 24'. In addition, a pressure commander 42-3 of the control unit 40-3 includes a converter 42*c* that receives a crank angle signal. The converter 42*c* converts a crank angle into a slide position on the basis of the crank angle signal, and outputs a slide position signal indicating the slide position to the press load commander 42*a*.

Then, pressure controllers 44-3, 44-3' of the control unit 40-3 respectively receive: angular velocity signals respectively indicating the angular velocities of the electric servomotors 3, 3' from angular velocity detectors 13, 13'; pressure signals respectively indicating the pressures of the hydraulic pressure chambers 24, 24' from pressure detectors 11, 11'; cylinder position signals respectively indicating the cylinder positions of the in-slide cylinders 25, 25' from the cylinder position detectors 19, 19'; the crank angular velocity signal indicating the crank angular velocity from the angular velocity detector 14; and the crank angle signal indicating the angle from the angle detector 16. The pressure controllers 44-3, 44-3' respectively calculate and determine torque commands for controlling the torques of the electric servomotors 3, 3' on the basis of the pressure command supplied from the pressure commander 42 and the signals detected by the respective detectors. The pressure controllers 44-3, 44-3' output the determined torque commands respectively to the electric servomotors 3, 3' via servo amplifiers 46, 46', to thereby perform such control that the pressures of the hydraulic pressure chambers 24, 24' each become a target value (the pressure indicated by the pressure command). Note that, the cylinder position signals respectively indicating the cylinder positions of the in-slide cylinders 25, 25' are used as compensating devices for the pressure control of the hydraulic pressure chambers 24, 24'.

According to the third embodiment, the pressures of the hydraulic pressure chambers 24, 24' of the respect cylinder-piston mechanisms are each controlled, whereby an eccentric press load can be prevented from being applied even if the slide 25 has a large size.

Configuration of Press Load Controlling Apparatus for Mechanical Press

Fourth Embodiment

Figure 9:
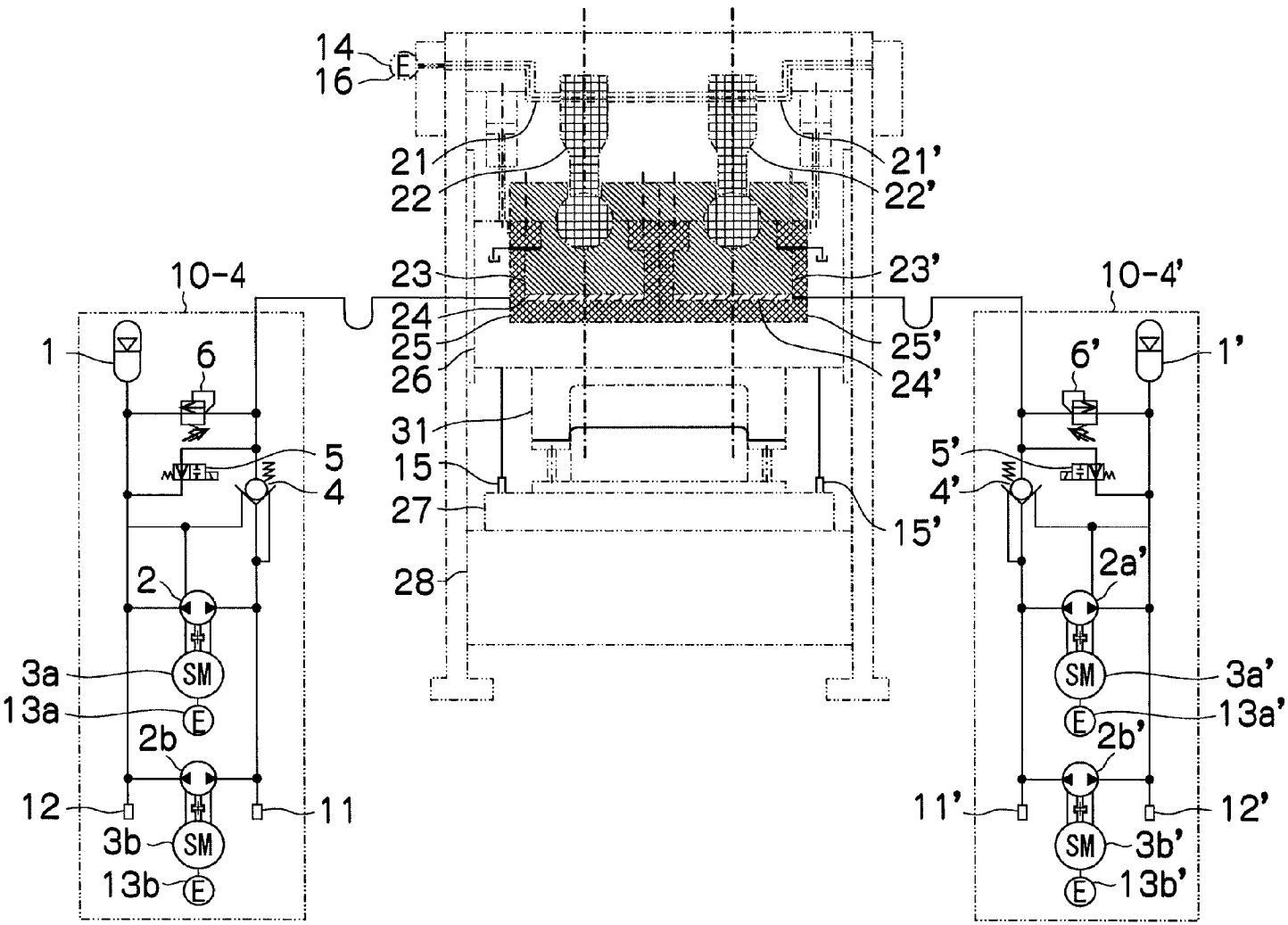
FIG. 9 is a configuration diagram illustrating a fourth embodiment of the press load controlling apparatus for the mechanical press according to the presently disclosed subject matter.
Figure 10:
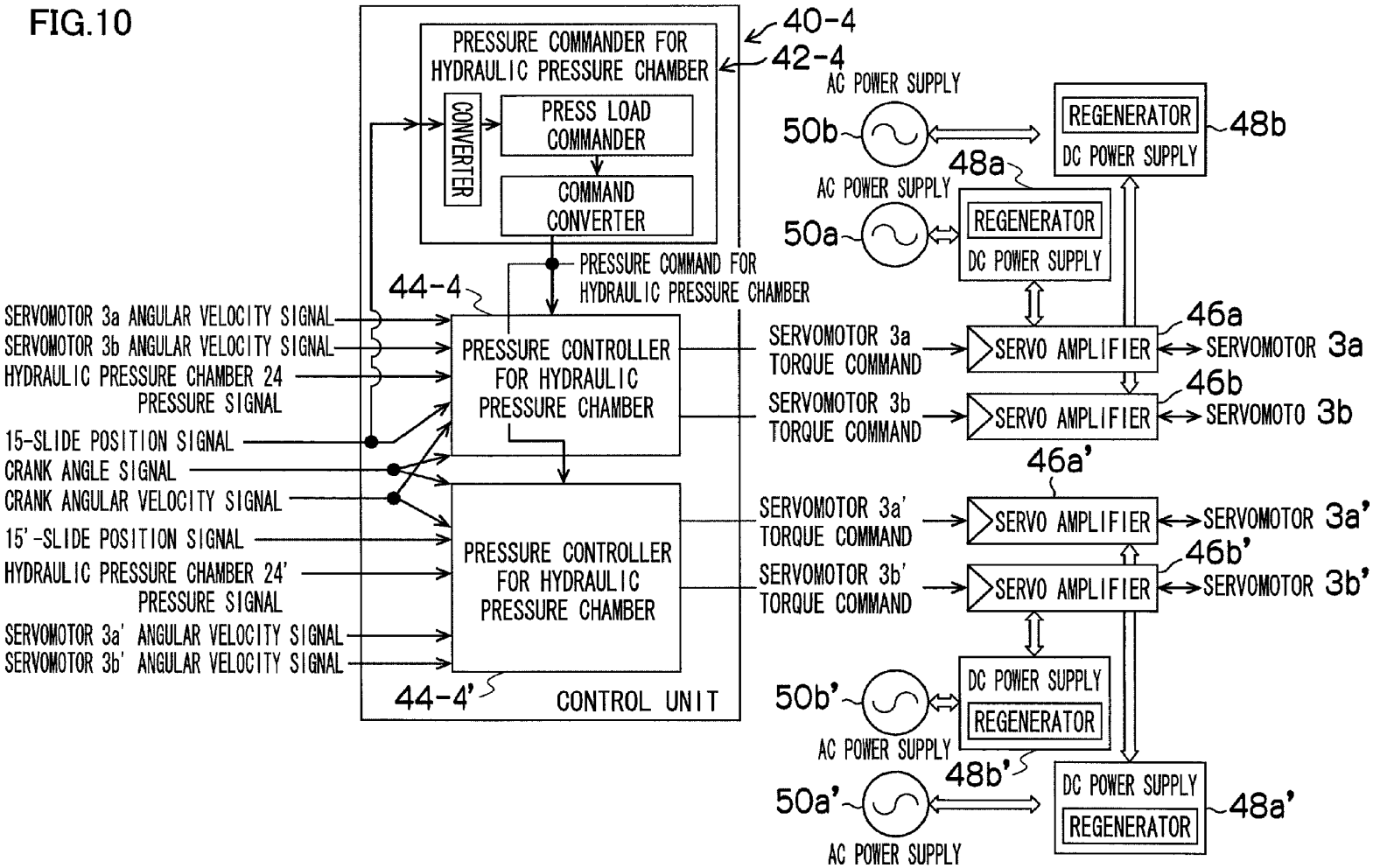
FIG. 10 is a block diagram illustrating a control unit in the press load controlling apparatus for the mechanical press illustrated in FIG. 9.

FIG. 9 is a configuration diagram illustrating a fourth embodiment of the press load controlling apparatus for the mechanical press according to the presently disclosed subject matter. FIG. 10 is a block diagram illustrating a control unit in the press load controlling apparatus for the mechanical press according to the fourth embodiment.

The press load controlling apparatus for the mechanical press according to the fourth embodiment illustrated in FIG. 9 and FIG. 10 is different mainly in that hydraulic circuits 10-4, 10-4' and pressure controllers 44-4, 44-4' are provided instead of the hydraulic circuits 10, 10' and the pressure controllers 44-3, 44-3' of the control unit 40-3 in the press load controlling apparatus according to the third embodiment illustrated in FIG. 7 and FIG. 8. Note that, in FIG. 9 and FIG. 10, elements common to those of the third embodiment illustrated in FIG. 7 and FIG. 8 are designated by the same reference numerals and characters, and detailed description thereof will be omitted.

The hydraulic circuits 10-4, 10-4' in the press load controlling apparatus for the mechanical press according to the fourth embodiment illustrated in FIG. 9 are different mainly in that two left-right pairs of hydraulic pump/motors and two left-right pairs of electric servomotors (hydraulic pump/motors 2*a*, 2*a*' and hydraulic pump/motors 2*b*, 2*b*', and electric servomotors 3*a*, 3*a*' and electric servomotors 3*b*, 3*b*') are provided instead of one left-right pair of the hydraulic pump/motors 2, 2' and one left-right pair of the electric servomotors 3, 3' according to the third embodiment.

Note that, the fourth embodiment is the same as the second embodiment illustrated in FIG. 5 in that two sets of the hydraulic pump/motor and the electric serve motor are provided in each of the hydraulic circuits 10-4, 10-4'.

Meanwhile, a control unit 40-4 in the press load controlling apparatus for the mechanical press according to the fourth embodiment illustrated in FIG. 10 controls the torques of the two left-right pairs of the electric servomotors 3*a*, 3*a*' and 3*b*, 3*b*', to thereby control the pressures of one left-right pair of the hydraulic pressure chambers 24, 24'.

That is, pressure controllers 44-4, 44-4' of the control emit 40-4 respectively receive: angular velocity signals respectively indicating the angular velocities of the electric servomotors 3*a*, 3*b* and 3*a*', 3*b*' from angular velocity detectors 13*a*, 13*b* and 13*a*', 13*b*'; the pressure signals respectively indicating the pressures of the hydraulic pressure chambers 24, 24' from the pressure detectors 11, 11'; slide position signals respectively indicating the slide positions of slide position detectors 15, 15'; the crank angular velocity signal indicating the crank angular velocity from the angular velocity detector 14; and the crank angle signal indicating the angle from the angle detector 16. The pressure controllers 44-4, 44-4' respectively calculate and determine torque commands for controlling the torques of the electric servomotors 3*a*, 3*b* and 3*a*', 3*b*' on the basis of a pressure command supplied from a pressure commander 42-4 and the signals detected by the respective detectors. The pressure controllers 44-4, 44-4' output the determined torque commands respectively to the electric servomotors 3*a*, 3*b* and 3*a*', 3*b*' via servo amplifiers 46*a*, 46*b* and 46*a*', 46*b*', to thereby perform such control that the pressures of the hydraulic pressure chambers 24, 24' each become a target value t pressure indicated by the pressure command).

In addition, the pressure controllers 44-4, 44-4' respectively calculate the cylinder positions of the in-slide cylinders 25, 25' on the basis of the slide positions detected by the slide position detectors 15, 15' and the crank angle detected by the angle detector 16, and the calculated cylinder positions are used for compensating the pressure control of the hydraulic pressure chambers 24, 24'.

[Others]

In the embodiments described above, description is given of the case where an oil is used as the hydraulic fluid of the press load controlling apparatus, but no limited thereto, other liquids such as water may be used. In addition, not limited to a crank press, the press load controlling apparatus according to the presently disclosed subject matter can be applied to other mechanical presses such as a link press.

In addition, it goes without saying that, not limited to the embodiments described above, the presently disclosed subject matter can be variously modified within a range not departing from the spirit of the presently disclosed subject matter.

What is claimed is:

1. A press load controlling apparatus for a mechanical press, comprising:

a cylinder-piston mechanism provided in a slide of the mechanical press, the slide having one part of a die and being configured to move the one part of the die toward another part of the die to shape a workpiece;

a relief valve configured to act when a pressure of a hydraulic pressure chamber of the cylinder-piston mechanism exceeds a set overload pressure;

a hydraulic pump/motor connected to the hydraulic pressure chamber of the cylinder-piston mechanism;

an electric servomotor connected to a rotating shaft of the hydraulic pump/motor;

a pressure detecting device configured to detect the pressure of the hydraulic pressure chamber of the cylinder-piston mechanism;

a pressure commanding device configured to command the pressure of the hydraulic pressure chamber on a basis of a preset press load command; and a controlling device configured to control a torque of the electric servomotor on a basis of a pressure command from the pressure commanding device and the pressure detected by the pressure detecting device, to thereby control the pressure of the hydraulic pressure chamber of the cylinder-piston mechanism.

2. The press load controlling apparatus for a mechanical press according to claim 1, further comprising a regenerating device configured to supply power of a pressure liquid as electrical energy back to a power supply via the hydraulic pump/motor and the electric servomotor, the power being generated when the pressure of the hydraulic pressure chamber of the cylinder-piston mechanism is reduced.

3. The press load controlling apparatus for a mechanical press according to claim 1, further comprising an angular velocity detector configured to detect a rotation angular velocity of the electric servomotor, wherein the controlling device uses the angular velocity detected by the angular velocity detector as angular velocity feedback for securing dynamic stability of the pressure.

4. The press load controlling apparatus for a mechanical press according to claim 1, further comprising an angle detector configured to detect a crank angle of a crank of the mechanical press, wherein the pressure commanding device commands the pressure of the hydraulic pressure chamber using one of the crank angle detected by the angle detector and a slide position of the slide calculated from the crank angle.

5. The press load controlling apparatus for a mechanical press according to claim 1, further comprising a slide position detector configured to detect a slide position of the slide of the mechanical press, wherein the pressure commanding device commands the pressure of the hydraulic pressure chamber using the slide position of the slide detected by the slide position detector.

6. The press load controlling apparatus for a mechanical press according to claim 4, wherein the pressure commanding device commands the pressure of the hydraulic pressure chamber along an allowable pressure-application capacity curve using the slide position of the slide, and commands, in a vicinity of a bottom dead center of the slide, the pressure of the hydraulic pressure chamber along a constant value equal to or less than the allowable pressure-application capacity curve in order to secure shaping performance.

7. The press load controlling apparatus for a mechanical press according to claim 5, wherein the pressure commanding device commands the pressure of the hydraulic pressure chamber along an allowable pressure-application capacity curve using the slide position of the slide, and commands, in a vicinity of a bottom dead center of the slide, the pressure of the hydraulic pressure chamber along a constant value equal to or less than the allowable pressure-application capacity curve in order to secure shaping performance.

8. The press load controlling apparatus for a mechanical press according to claim 1, further comprising:

an angular velocity detector configured to detect a crank angular velocity of a crank of the mechanical press; and an angle detector configured to detect a crank angle of the crank of the mechanical press, wherein the controlling device uses a slide velocity calculated from the crank angular velocity detected by the angular velocity detector and the crank angle detected by the angle detector, for compensating pressure control of the hydraulic pressure chamber.

9. The press load controlling apparatus for a mechanical press according to claim 1, further comprising a slide velocity detector configured to detect a slide velocity of the slide of the mechanical press, wherein the controlling device uses the slide velocity detected by the slide velocity detector, for compensating pressure control of the hydraulic pressure chamber.

10. The press load controlling apparatus for a mechanical press according to claim 1, further comprising:

a slide position detector configured to detect a slide position of the slide of the mechanical press; and an angle detector configured to detect a crank angle of a crank of the mechanical press, wherein the controlling device uses a cylinder position of the cylinder-piston mechanism calculated from the slide position detected by the slide position detector and the crank angle detected by the angle detector, for compensating the pressure control of the hydraulic pressure chamber.

11. The press load controlling apparatus for a mechanical press according to claim 1, further comprising a cylinder position detector configured to detect a cylinder position of the cylinder-piston mechanism, wherein the controlling device uses the cylinder position detected by the cylinder position detector, for compensating the pressure control of the hydraulic pressure chamber.

12. A press load controlling apparatus for a mechanical press, comprising:

a plurality of cylinder-piston mechanisms provided in a slide of the mechanical press, the slide having one part of a die and being configured to move the one part of the die toward another part of the die to shape a workpiece;

a plurality of relief valves configured to act when pressures of hydraulic pressure chambers of the plurality of cylinder-piston mechanisms each exceed a set overload pressure;

a plurality of hydraulic pump/motors respectively connected to the hydraulic pressure chambers of the plurality of cylinder-piston mechanisms;

a plurality of electric servomotors respectively connected to rotating shafts of the plurality of hydraulic pump/motors;

a plurality of pressure detecting devices respectively configured to detect the pressures of the hydraulic pressure chambers of the plurality of cylinder-piston mechanisms;

a pressure commanding device configured to command the pressures of the hydraulic pressure chambers on a basis of a preset press load command; and a controlling device configured to control torques of the plurality of electric servomotors on a basis of a pressure command from the pressure commanding device and the pressures respectively detected by the plurality of pressure detecting devices, to thereby control the pressures of the hydraulic pressure chambers of the plurality of cylinder-piston mechanisms.

13. The press load controlling apparatus for a mechanical press according to claim 12, further comprising a regenerating device configured to supply power of a pressure liquid as electrical energy back to a power supply via the hydraulic pump/motor and the electric servomotor, the power being generated when the pressure of the hydraulic pressure chamber of the cylinder-piston mechanism is reduced.

14. The press load controlling apparatus for a mechanical press according to claim 12, further comprising an angular velocity detector configured to detect a rotation angular velocity of the electric servomotor, wherein the controlling device uses the angular velocity detected by the angular velocity detector as angular velocity feedback for securing dynamic stability of the pressure.

15. The press load controlling apparatus for a mechanical press according to claim 12, further comprising an angle detector configured to detect a crank angle of a crank of the mechanical press, wherein the pressure commanding device commands the pressure of the hydraulic pressure chamber using one of the crank angle detected by the angle detector and a slide position of the slide calculated from the crank angle.

16. The press load controlling apparatus for a mechanical press according to claim 12, further comprising a slide position detector configured to detect a slide position of the slide of the mechanical press, wherein the pressure commanding device commands the pressure of the hydraulic pressure chamber using the slide position of the slide detected by the slide position detector.

17. The press load controlling apparatus for a mechanical press according to claim 15, wherein the pressure commanding device commands the pressure of the hydraulic pressure chamber along an allowable pressure-application capacity curve using the slide position of the slide, and commands, in a vicinity of a bottom dead center of the slide, the pressure of the hydraulic pressure chamber along a constant value equal to or less than the allowable pressure-application capacity curve in order to secure shaping performance.

18. The press load controlling apparatus for a mechanical press according to claim 16, wherein the pressure commanding device commands the pressure of the hydraulic pressure chamber along an allowable pressure-application capacity curve using the slide position of the slide, and commands, in a vicinity of a bottom dead center of the slide, the pressure of the hydraulic pressure chamber along a constant value equal to or less than the allowable pressure-application capacity curve in order to secure shaping performance.

19. The press load controlling apparatus for a mechanical press according to claim 12, further comprising:

an angular velocity detector configured to detect a crank angular velocity of a crank of the mechanical press; and an angle detector configured to detect a crank angle of the crank of the mechanical press, wherein the controlling device uses a slide velocity calculated from the crank angular velocity detected by the angular velocity detector and the crank angle detected by the angle detector, for compensating pressure control of the hydraulic pressure chamber.

20. The press load controlling apparatus for a mechanical press according to claim 12, further comprising a slide velocity detector configured to detect a slide velocity of the slide of the mechanical press, wherein the controlling device uses the slide velocity detected by the slide velocity detector, for compensating pressure control of the hydraulic pressure chamber.

21. The press load controlling apparatus for a mechanical press according to claim 12, further comprising:

a slide position detector configured to detect a slide position of the slide of the mechanical press; and an angle detector configured to detect a crank angle of a crank of the mechanical press, wherein the controlling device uses a cylinder position of the cylinder-piston mechanism calculated from the slide position detected by the slide position detector and the crank angle detected by the angle detector, for compensating the pressure control of the hydraulic pressure chamber.

22. The press load controlling apparatus for a mechanical press according to claim 12, further comprising a cylinder position detector configured to detect a cylinder position of the cylinder-piston mechanism, wherein the controlling device uses the cylinder position detected by the cylinder position detector, for compensating the pressure control of the hydraulic pressure chamber.

* * * * *